US008876333B1

(12) United States Patent
Rashidi

(10) Patent No.: US 8,876,333 B1
(45) Date of Patent: Nov. 4, 2014

(54) LED RECESSED LUMINAIRE WITH UNIQUE HEAT SINK TO DISSIPATE HEAT FROM THE LED

(76) Inventor: Hamid Rashidi, Beverly Hills, CA (US)

( * ) Notice: Subject to any disclaimer, the term of this patent is extended or adjusted under 35 U.S.C. 154(b) by 826 days.

(21) Appl. No.: 12/803,124

(22) Filed: Jun. 19, 2010

(51) Int. Cl.
*F21S 4/00* (2006.01)
*F21V 29/00* (2006.01)

(52) U.S. Cl.
CPC ..... *F21V 29/2231* (2013.01); *F21V 29/26* (2013.01)
USPC ..... 362/294

(58) Field of Classification Search
USPC ..... 313/45–46; 362/294, 373
See application file for complete search history.

(56) References Cited

U.S. PATENT DOCUMENTS

| | | | | |
|---|---|---|---|---|
| 7,611,264 | B1 * | 11/2009 | Chang et al. | 362/249.02 |
| 2009/0141500 | A1 * | 6/2009 | Peng | 362/294 |
| 2009/0219727 | A1 * | 9/2009 | Weaver | 362/373 |
| 2010/0110691 | A1 * | 5/2010 | Hsu et al. | 362/294 |
| 2010/0127637 | A1 * | 5/2010 | Alexander et al. | 315/294 |
| 2011/0128730 | A1 * | 6/2011 | Chiu | 362/235 |

* cited by examiner

*Primary Examiner* — Britt D Hanley
(74) *Attorney, Agent, or Firm* — Thomas I. Rozsa

(57) ABSTRACT

A uniquely shaped heat sink which has a lower generally elliptical interior shape which extends to an upper generally circular interior shape, the heat sink having a multiplicity of radial fins a portion of which surround the elliptical shaped lower exterior, the multiplicity of lower radial fins integrally formed with a multiplicity of upper radial fins which surround the upper interior circular shape of the heat sink. The multiplicity of upper radial fins form an upper air gap between the fins and an upper surface the plate. As the body heats up, the multiplicity of fins transfer the heat from an LED press fit retained against the heat sink to the edge of the heat sink.

7 Claims, 17 Drawing Sheets

LED RECESSED LUMINAIRE WITH UNIQUE HEAT SINK TO DISSIPATE HEAT FROM THE LED

BACKGROUND OF THE INVENTION

1. Field of the Invention

The present invention relates to the field of recessed lighting luminaires and in particular to recessed lighting luminaires which are housed in a canister which is retained in the ceiling of a structure. The present invention also relates to the field of luminaires which utilize one or more LEDs as the source of illumination and apparatus by which heat from the LED is dissipated.

2. Description of the Prior Art

With the development of semiconductor lighting devices, LED lighting sources are in great demand in lighting luminaires used in both consumer and industrial markets. One problem with LED lighting luminaires and in particular with recessed lighting luminaires is that the LED lamp generates considerable heat and due to its confined space in a ceiling of a structure, heat dissipation is difficult to achieve. Excess heat can result in failure of the operating components of the lighting luminaire.

There is a significant need for an improved heat sink apparatus and method to efficiently dissipate heat from the LED to help extend the usable life of the LED and to comply with heat dissipation lighting standards as required by law.

SUMMARY OF THE INVENTION

The present invention is a recessed lighting fixture utilizing an LED lamp which includes significant design improvements in the heat sink used to dissipate heat generated from the LED.

The significant design improvement is in a uniquely shaped heat sink which has a body with a lower generally elliptical shaped base which extends to an upper generally circular top surface, the heat sink having a multiplicity radial fins which include a lower section of radial fins which surround the elliptical shaped lower exterior, lower section of radial fins extending to an upper section of radial fins which surround the upper interior circular top surface of the heat sink.

The heat sink body and the multiplicity of radial fins are all made of metal such as stainless steel or aluminum and are cast as one piece. This design is unique and enables the heat sink to dissipate heat generated from an LED affixed to a printed circuit board press fit retained against the heat sink base. Heat generated from the LED is transferred to the heat sink base and the heat then travels along the lower section of radial fins from their elliptical orientation outwardly along the fins and heat also moves through the body and into the upper section of radial fins and then outwardly along both upper and lower sections of radial fins. Heat traveling along both upper and lower sections of radial fins is then caused to move to the space in the structure located above the heat sink. As a result of this unique design, the LED runs cooler and will therefore have a longer life than prior art LEDs that do not have the benefit of the present invention heat sink. The mounting surface for the LED is elliptical in overall shape when the lower section of the multiplicity of lower fins are included. The heat from the LED is transferred from the base of the heat sink to the body and out to the fins. As the body heats up, the multiplicity of fins transfer the heat from the LED to the edge of the heat sink. Therefore, the present invention provides much better heat dissipation than prior at designs.

The present invention is a luminaire comprising: (a) a heat sink cast from a single piece of metal including a base having a generally circular central section, a first extension section and a second extension section which together form a generally elliptical shape; (b) a printed circuit board with a heat transmitting gel on an upper surface and containing an LED affixed to a lower surface, the printed circuit board retained against a lower surface of the generally circular central section of the base so that at least a portion the upper surface and heat transmitting gel contact the base of the heat sink; ĉ the heat sink includes a body with a multiplicity of integrally cast spaced apart radial fins extending from the body in an outward radial direction, an air gap between adjacent radial fins, a portion of the body aligned with and having a shape conforming to the shape of the base and a lower section of each of the multiplicity of radial fins having an interior portion which extend from a portion of the body which conforms to the shape of the base, each fin of the lower section of radial fins extending radially outward to an exterior portion having a widened body portion; (d) the body extending from the base to a top surface, an upper section of the multiplicity of radial fins each having an interior portion with a lower surface in contact with the top surface of the body, the upper section of the multiplicity of radial fins surrounding the body with an interior surface of each interior portion of the upper section of the multiplicity of radial fins and the top surface of the body forming an internal air gap, the upper section of radial fins extending radially outward to an exterior portion having a widened body portion; and (e) a respective fin section from the upper section of the multiplicity of radial fins aligned with a respective fin section from the lower section of the multiplicity of radial fins, each upper and lower aligned fin section separated from an adjacent aligned upper and lower fin section by at least one air gap the heat sink body and multiplicity of radial fins are cast from a single piece of metal so that heat generated from the LED is transferred to and adsorbed into the base and the heat then travels through the body and into the multiplicity of radial fins and the heat is then caused to move to a space in a structure located above the heat sink and as a result heat generated by the LED is efficiently dissipated from the LED.

The present invention focuses on a heat sink for use with a luminaire, the heat sink comprising: (a) a heat sink cast from a single piece of metal including a base having a generally circular central section, a first extension section and a second extension section which together form a generally elliptical shape; (b) the heat sink includes a body with a multiplicity of integrally cast spaced apart radial fins extending from the body in an outward radial direction, an air gap between adjacent radial fins, a portion of the body aligned with and having a shape conforming to the shape of the base and a lower section of each of the multiplicity of radial fins having an interior portion which extend from a portion of the body which conforms to the shape of the base, each fin of the lower section of radial fins extending radially outward to an exterior portion having a widened body portion; (c) the body extending from the base to a top surface, an upper section of the multiplicity of radial fins each having an interior portion with a lower surface in contact with the top surface of the body, the upper section of the multiplicity of radial fins surrounding the body with an interior surface of each interior portion of the upper section of the multiplicity of radial fins and the top surface of the body forming an internal air gap, the upper section of radial fins extending radially outward to an exterior portion having a widened body portion; and (d) a respective fin section from the upper section of the multiplicity of radial fins aligned with a respective fin section from the lower section of the multiplicity of radial fins, each upper and lower aligned fin section separated from an adjacent aligned upper and lower fin section by at least one air gap the heat sink body and multiplicity of radial fins are cast from a single piece of metal so that heat is absorbed into the body and then travels through the body and into the multiplicity of radial fins and away from the heat sink.

In addition, the present invention is a heat sink for use with a luminaire, the heat sink comprising: (a) a heat sink made of metal and including a base with a multiplicity of sections which together form a given shape; (b) the heat sink includes a body with a multiplicity of integral spaced apart radial fins extending from the body in an outward radial direction, an air gap between adjacent radial fins, a portion of the body aligned with and having a shape conforming to the shape of the base and a lower section of at least several of the multiplicity of radial fins having an interior portion which extend from a portion of the body which conforms to the shape of the base, each fin of the lower section of radial fins extending radially outward to an exterior portion having a widened body portion; (c) a portion of the body extending from the base to a top surface, an upper section with several of the multiplicity of radial fins having an interior portion with a lower surface in contact with the top surface of the body, several of fins of the upper section of the multiplicity of radial fins surrounding the body with an interior surface of an interior portion of the several of the upper section of the multiplicity of radial fins and the top surface of the body forming an internal air gap, the upper section of radial fins extending radially outward to an exterior portion having a widened body portion; and (d) a respective fin section from the upper section of the multiplicity of radial fins aligned with a respective fin section from the lower section of the multiplicity of radial fins, the heat sink body and multiplicity of radial fins are integrally formed from metal so that heat is transferred through the base and the heat then travels through the body and into the multiplicity of radial fins and away from the heat sink.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is illustrated a top perspective exploded view of the key components of the present invention LED recessed luminaire with unique heat sink. Referring to FIG. 2, there is illustrated a bottom perspective exploded view of the key components of the present invention LED recessed luminaire with unique heat sink.

Figure 3:
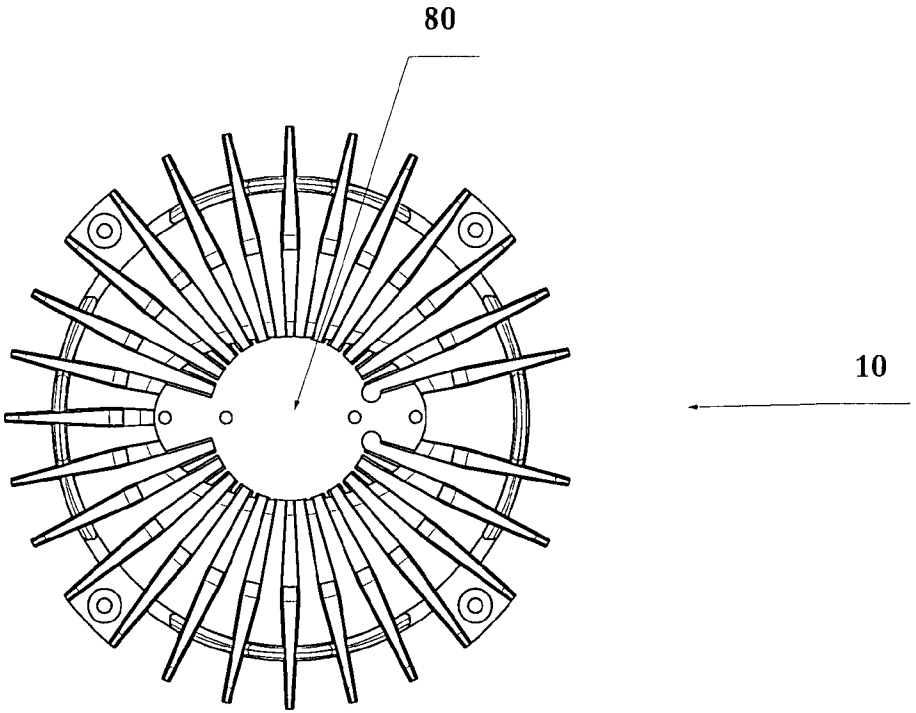
FIG. 3 is a bottom plan view of the unique heat sink of the present invention LED recessed luminaire.
Figure 4:
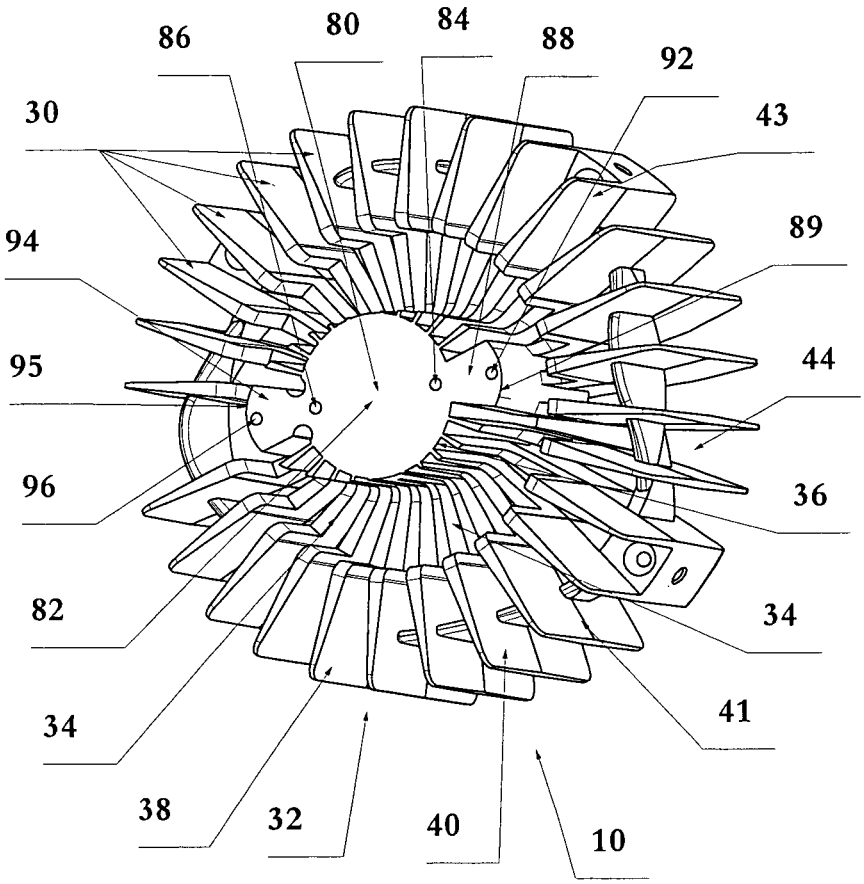
FIG. 4 is a bottom perspective view of the unique heat sink of the present invention LED recessed luminaire.
Figure 5:
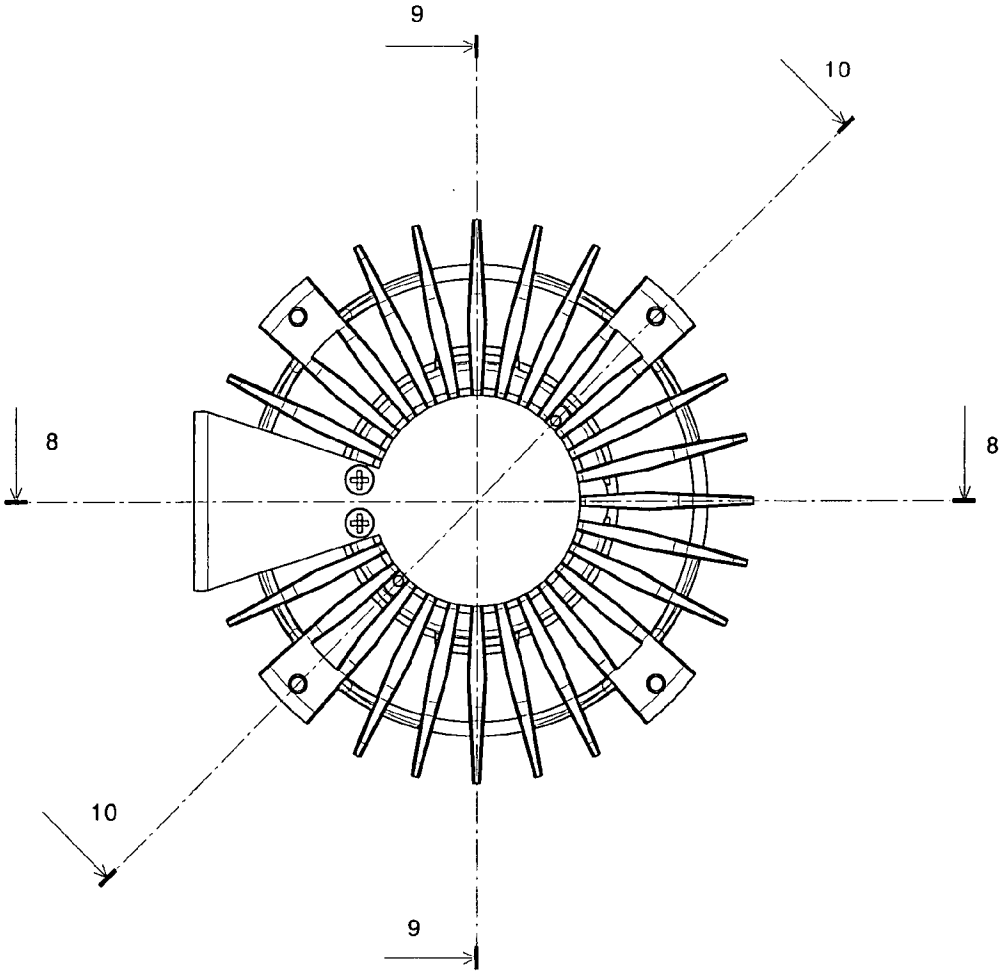
FIG. 5 is a top plan view of the unique heat sink of the present invention with a bracket attached.
Figure 6:
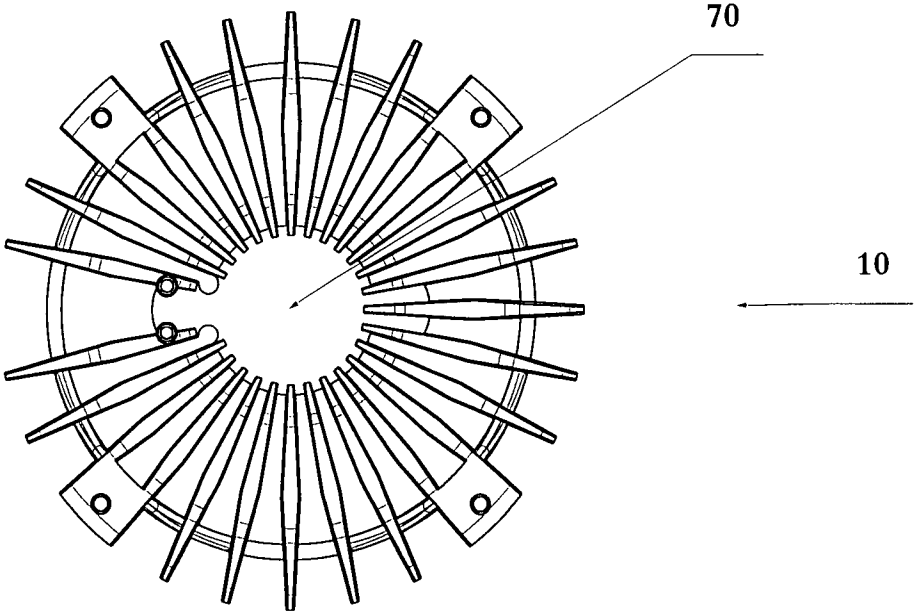
FIG. 6 is a top plan view of the present invention heat sink with the bracket removed.
Figure 7:
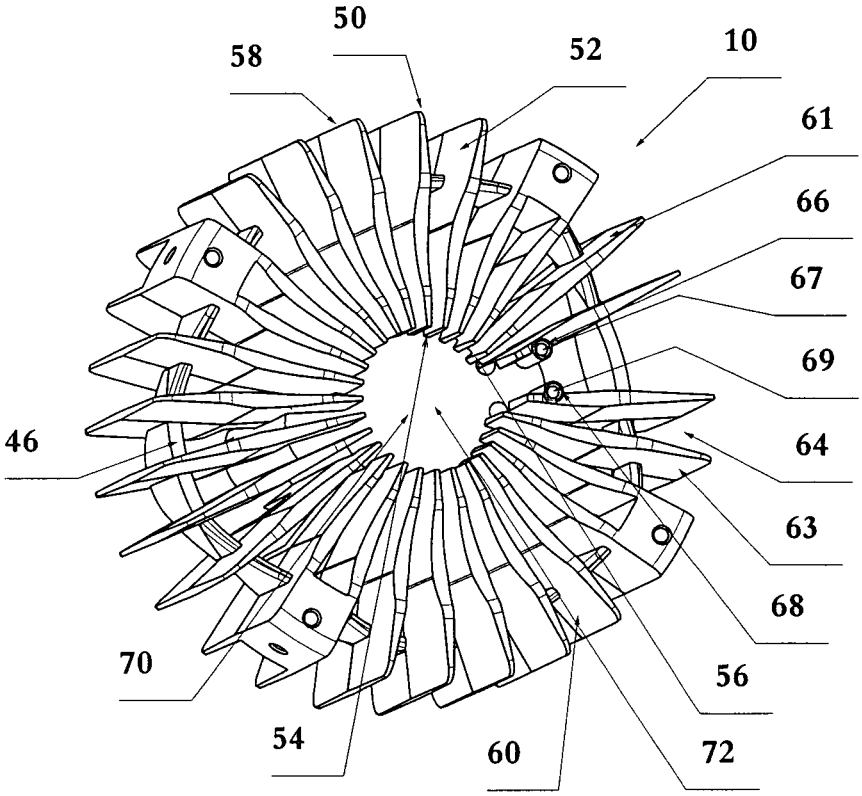
FIG. 7 is a top perspective view of the present invention heat sink.

The significant improvement is the unique heat sink 10. The heat sink 10 is illustrated in detail in the bottom plan view of FIG. 3, the bottom perspective view of FIG. 4, the top plan views of FIGS. 5 and 6, the top perspective view of FIG. 7, the cross-sectional view of FIG. 8 taken along line 8-8 of FIG. 5, the cross-sectional view of FIG. 9 taken along line 9-9 of FIG. 5, and the cross-section view taken along line 10-10 of FIG. 5. Referring to FIGS. 3 through 10, the heat sink 10 has a body 12 which is formed as one piece including a core 14 surrounded and intersected by a multiplicity of radial fins 30 which is also cast as one piece with the core 14. As shown in the views of FIGS. 3 and 4 and cross-sectional views of FIGS. 8, 9 and 10, the core 14 has a lower surface 16 which is generally elliptical in shape and has a modified cross-section until it forms a circular shape on its top surface 70 as illustrated in FIGS. 6 and 7. The core 14 is cast as one piece with the multiplicity of radial fins 30.

Figure 8:
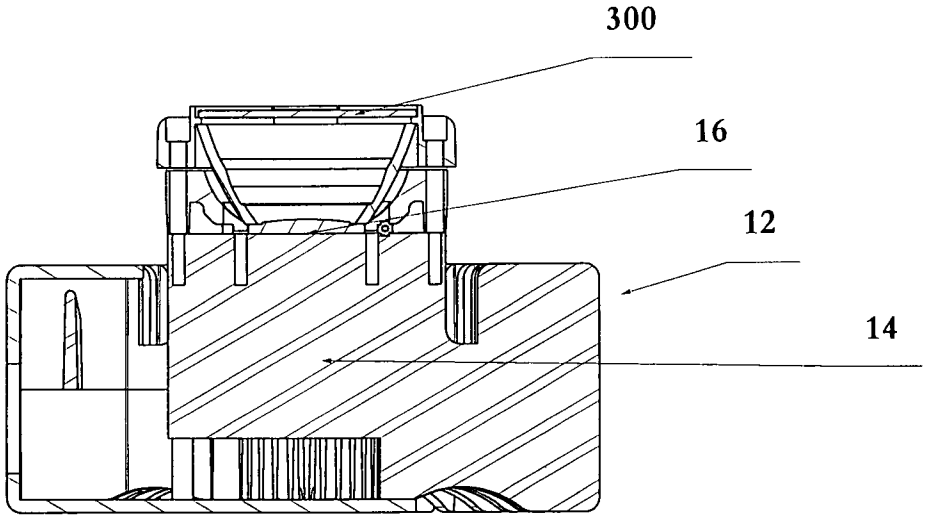
FIG. 8 is a cross-sectional view taken along line 8-8 of FIG. 5.
Figure 9:
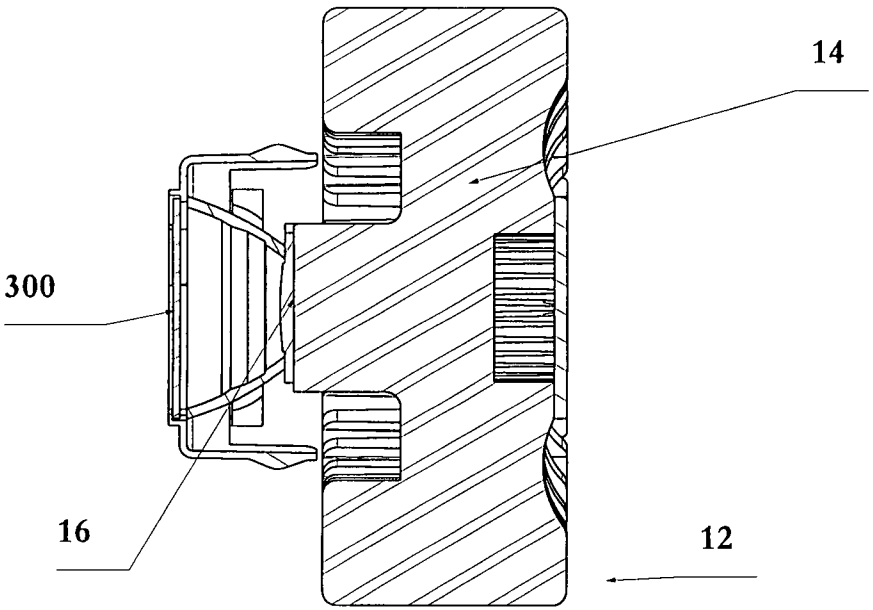
FIG. 9 is a cross-sectional view taken along line 9-9 of FIG. 5.
Figure 10:
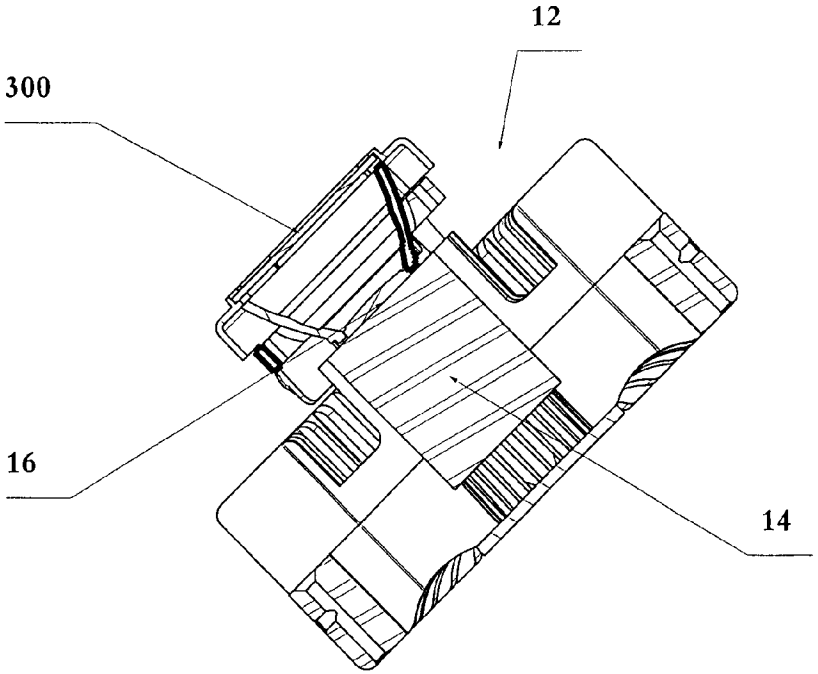
FIG. 10 is a cross-sectional view taken along line 10-10 of FIG. 5.
Figure 11:
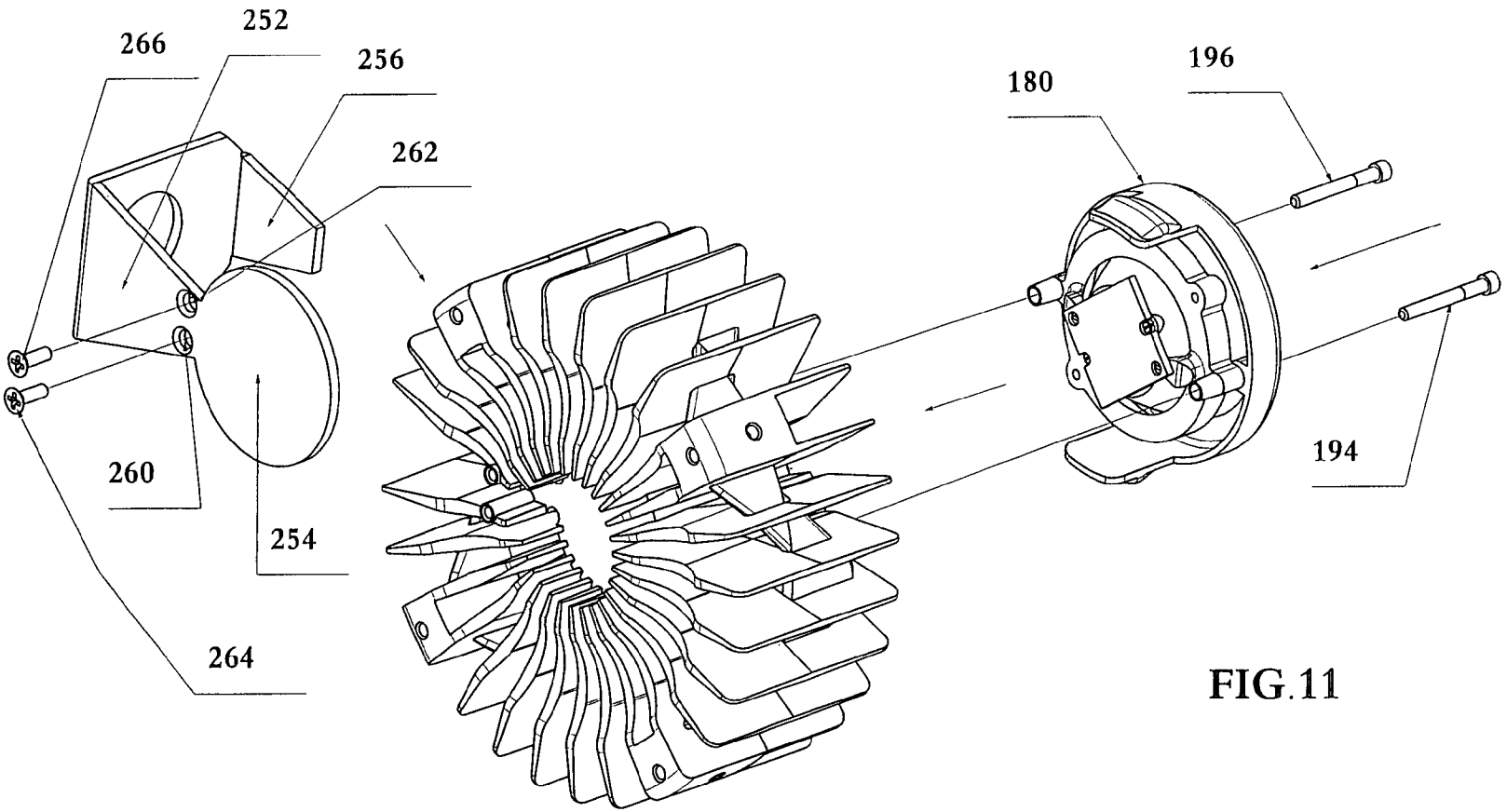
FIG. 11 is an exploded top perspective view of the bracket, heat sink and reflector cover of the present invention.

Referring to FIG. 4, the multiplicity of radial fins 30 is comprised of a lower section of fins 32 each of which include an interior portion 34 and an exterior portion 38. The lower section of radial fins 32 surrounds a generally elliptical shaped base 80 which is cast as part of the core 14 and is one piece but formed in three distinct sections, a central circular section 82 having a pair of oppositely disposed fastener receiving openings 84 and 86 which preferably contain internal threads, a first exterior section 88 which is a generally rounded frustum shape with its smaller end integral with the central circular section 82, the first exterior section having a fastener receiving opening 92 which preferably contains internal threads, and a second exterior section 94 which is a mirror image of the first exterior section 88, the second exterior section also being generally rounded frustum shaped with its smaller end integral with the central circular section 82, the second exterior section having a fastener receiving opening 96 which preferably contains internal threads. Referring to FIGS. 4, 8 and 9, the core is formed into the shape of the base for a portion of its vertical height.

Each of the fins of the lower section 32 of the multiplicity of fins 30 has an interior portion 34 having an interior end 36 which is formed integral with body 12 and surround body 12 primarily around the central circular section 82 of base 80 and extend upwards around body 12, with a select few of the fins having its interior end 36 touch an exterior of body 12 which extends from an outer wall 89 of first exterior section 88 or an outer wall 95 of second exterior section 94 of base 80. Each of the fins of lower section 32 extend to an exterior portion 38 having a widened body portion 40 which extend radially outward. Opposite faces 41 and 43 of each widened body portion 40 have an air gap 44. A circumferential heat transfer ring 46 extends between adjacent faces 41 and 43.

Referring to FIG. 7, the lower section 32 of the multiplicity of fins 30 extends to an upper section 50 of fins, each fin having an interior portion 52 and an exterior portion 58. The interior portion 52 of each fin has a lower surface 54 which is formed integral with and rests on top 70 surface of body 12, and the interior portion of each fin also has an interior surface 56. The top surface 70 and multiplicity of interior surfaces 56 of the top section 50 of the multiplicity of fins 30 form an internal air gap 72. Each exterior portion 58 has a widened body portion 60 which extend radially outward. Opposite faces 61 and 63 of each widened body portion 60 has an air gap 64. The heat sink 10 is formed as one integral one piece unit, with the body 12 and the multiplicity of fins 30 all cast as one piece. The fins of the upper section 50 and lower section 30 are aligned and their respective air gaps 44 and 64 are aligned. A pair of bosses 66 and 68 having internal fastener receiving channels 67 and 69 are formed into a pair of the upper section of fins. The channels 67 and 69 preferably have internal threads.

As a result of the design of the unique heat sink 10, any heat transmitted to base 80 travels into core 14 of body 12 and into each of the multiplicity of radial fins 30 and travels from each interior portion 34 to the exterior portion 36 of the lower section of 32 and each interior portion 52 to the exterior portion 58 of the upper section of fins 50 so that the multiplicity of radial fins 30 formed integral with the body 12 and base 80 and top 70 enable heat to be absorbed by and flow away from the base 80 and cool a heated object in heat transfer communication with base 80. The widened surfaces of the fins and the air gaps further facilitate heat transfer. The heat transfer ring 46 also facilitates heat transfer out of the heat sink.

Figure 1A:
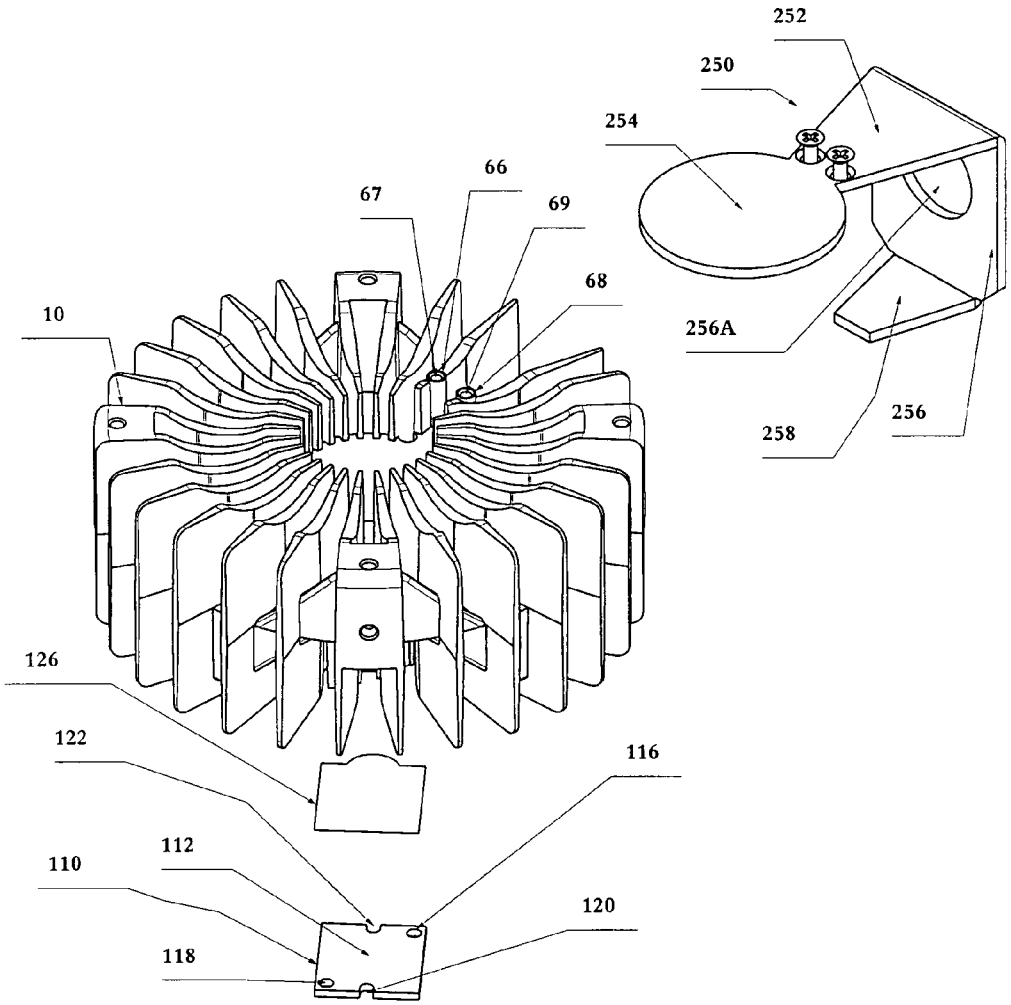
FIG. 1A and FIG. 1B together are an exploded top perspective view of the components of the present invention LED recessed luminaire before being connected to a reflector.
Figure 1B:
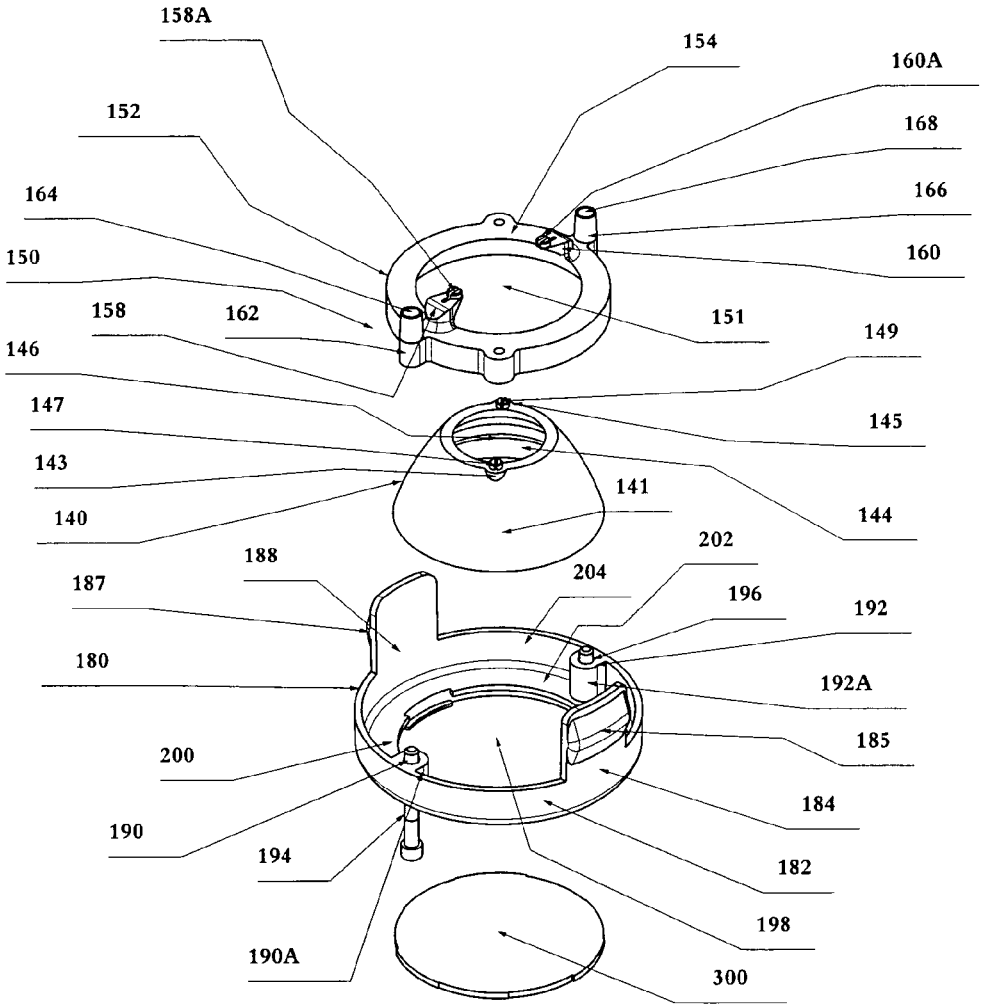
Figure 2:
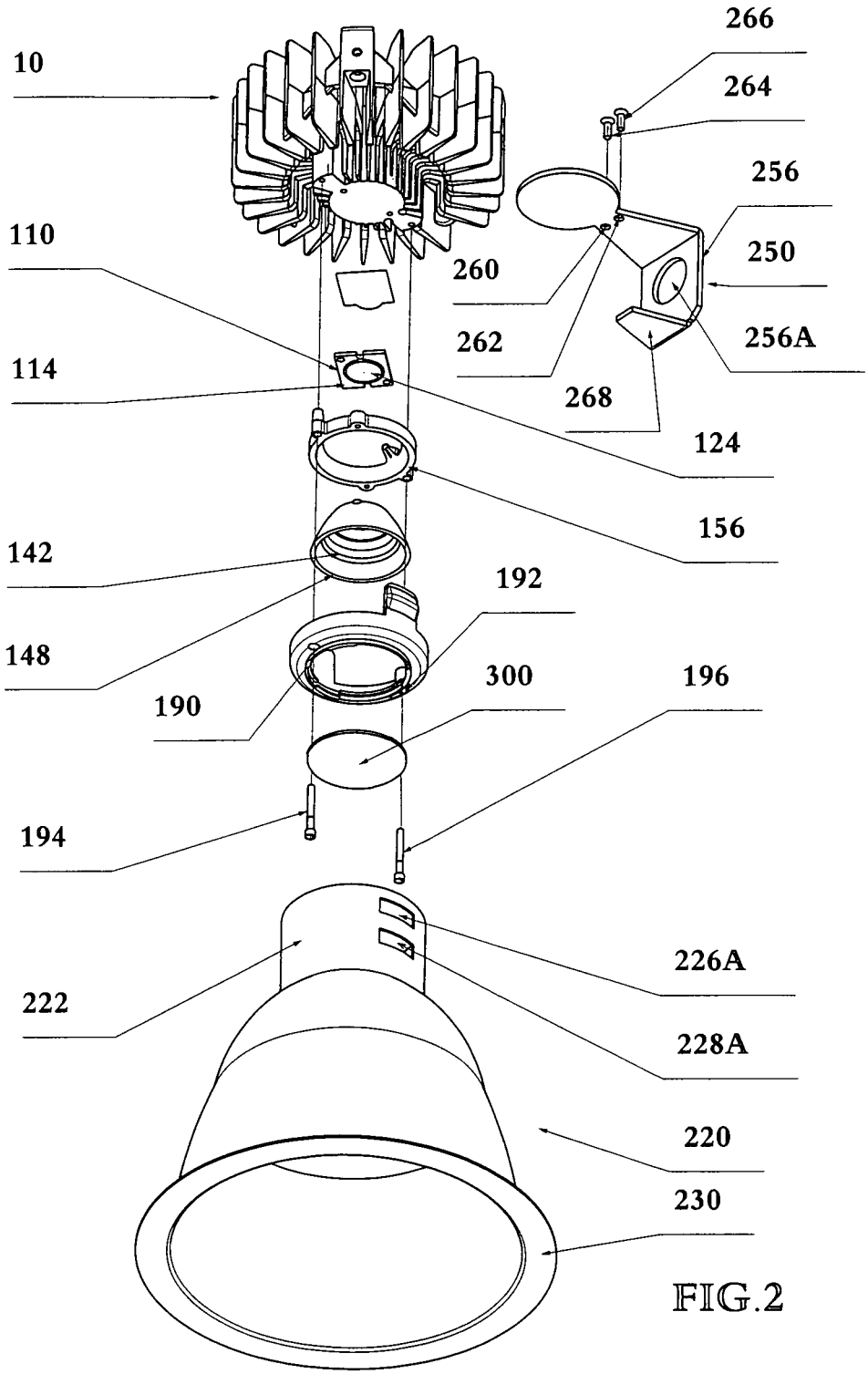
FIG. 2 is an exploded bottom perspective view of the components of the present invention LED recessed luminaire before being connected to a reflector, and also illustrating a luminaire reflector.

Referring to FIGS. 1A and 1B, a printed circuit board 110 has an upper surface 112 and a lower surface 114 and a pair of oppositely disposed openings 116 and 118 and a pair of oppositely disposed recesses 120 and 122. At least one Light Emitting Diode (LED) 124 is affixed to lower surface 114 and heat transmitting gel 126 is positioned on upper surface 112. As will be described, the printed circuit board 110 is press fit retained against the base 80 of heat sink 10 with heat transmitting gel 126 assisting in transmitting heat from the LED 124 to the base 80 of heat sink 10. Therefore, heat generated form the LED 124 is thermally transferred through the heat transmitting gel 126 to base 80 and then into the heat sink 10 to be dissipated.

The entire heat sink 10 including base 80, body 12 and the multiplicity of fins 30 are all made of metal such as stainless steel or aluminum. This design is unique and enables the heat sink 10 to dissipate heat generated from the LED 124. Heat generated from the LED 124 is transferred to the base 80 and the heat then travels into body 12 and along the lower section 32 of radial fins 30 from their elliptical orientation outwardly along the fins and heat also moves through the body 12 and into the upper section 50 of radial fins 30 and then outwardly along the fins. Heat traveling along radial fins 30 is then caused to move to the space in the structure located above the heat sink 10. As a result of this unique design, the LED 124 runs cooler and will therefore have a longer life than prior art LEDs that do not have the benefit of the present invention heat sink. The heat sink base 80 against which the printed circuit board 110 containing the LED 124 is retained is elliptical in overall shape when the multiplicity of lower section 32 of fins 30 are included. The heat from the LED 124 is transferred from the body 12 to the fins 30. As the core 14 of body 12 heats up, the multiplicity of fins 30 transfer the heat from the LED 124 to the edge of the heat sink 10. Therefore, the present invention provides much better heat dissipation than prior at designs.

Referring again to FIGS. 1 and 2, an internal reflector 140 having an exterior surface 141 and an interior surface 142 and is retained by a press fit between a frame assembly 150 and a cover assembly 180. Internal reflector 140 has a base 144 with an opening 146 leading to interior surface 142. Internal reflector 140 terminates in a circumferential face 148 which is oppositely disposed to base 144. A pair of oppositely disposed bosses 143 and 145 respectively contain pins 147 and 149 which are aligned on opposite sides of base 144.

Figure 14:
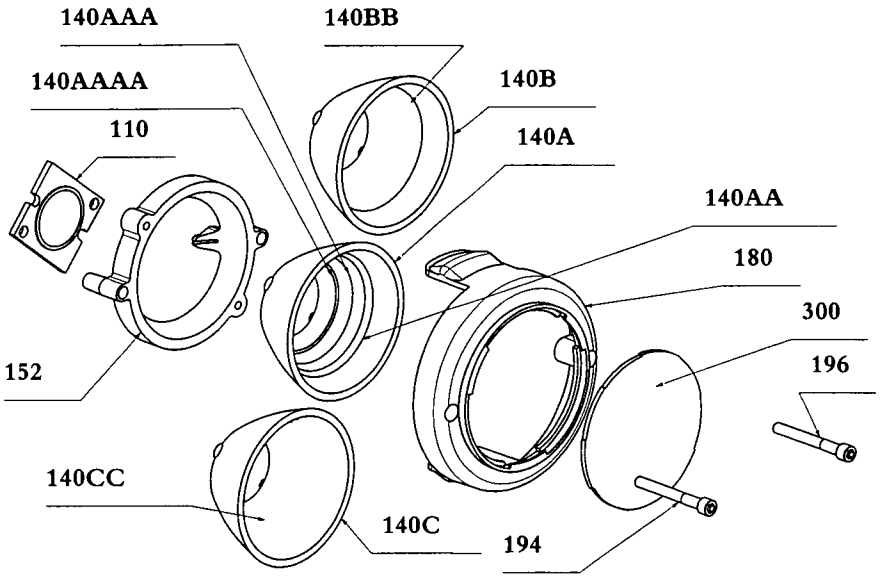
FIG. 14 is an exploded bottom perspective view of the printed circuit board and LED, frame member, interior reflector in three variations and reflector cover of the present invention.

The purpose of the interior reflector is to modify the illumination form the LEDs. FIG. 14 illustrates three variations of the internal reflector, 140A, 140B and 140C. Referring to 140A, the reflector has a multiplicity of interior steps 140AA, 140AAA, and 140AAAA. These interior steps enable the internal reflector 140 to cause the illumination from the LEDs 124 to be spots. With the angle as illustrated, the illumination spots are narrow. If the angle of the internal reflector 140A is wider, then the illumination spots from the LEDs will also be more widely distributed. Referring to the internal reflector 140C, the interior surface 140CC is completely smooth. This causes the illumination from the LEDs to be a flood illumination. If the angle of the interior 140CC is wider such as over 45 degrees, then the flood illumination will be a wide flood illumination. Referring to internal reflector 140B, there is a single step 140BB on the interior surface and this will cause the illumination from the LEDs 124 to be a narrow flood. Therefore, depending on the interior surface of the reflector, the illumination from the LEDs will be selected from the group consisting of flood, narrow flood, wide flood, spot and narrow spot.

The frame assembly 150 is a generally circular ring 152 surrounding an interior opening 151, the generally circular ring having an upper surface 154 and a lower surface 156. A pair of oppositely disposed pins 158A and 160A are respectively retained on interior extending members 158 and 160 which extend inwardly from generally circular ring 152 and into interior opening 151. When the frame assembly 150 is affixed to base 80 as will be described, a respective pin 158A and 160A is respectively received within a respective opening 118 and 116 of printed circuit board 110. A first boss 162 is formed into ring 152, the boss 162 having an internal opening 164 extending through boss 162. An oppositely disposed second boss 166 is formed into ring 152, the boss 166 having an internal opening 168 extending through boss 166. When the frame assembly 150 is affixed to the base 80 of heat sink 10 as will be described, the opening 164 of boss 162 is aligned with fastener receiving opening 96 in base 80 of heat sink 10 and opening 168 of boss 166 is aligned with fastener receiving openings 92 in base 80 of heat sink 10.

Figure 12:
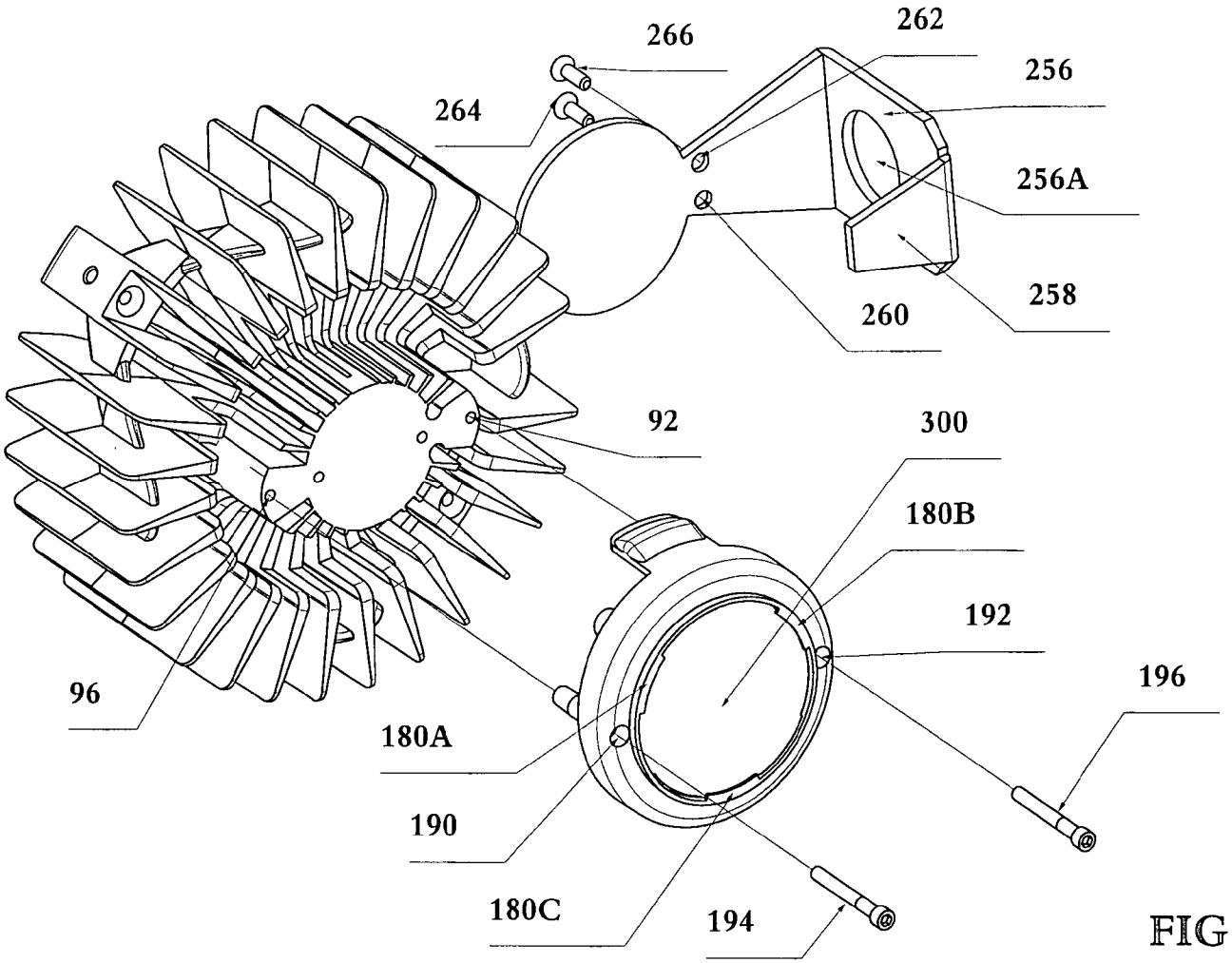
FIG. 12 is a bottom perspective view of the bracket, heat sink and reflector cover of the present invention.
Figure 13:
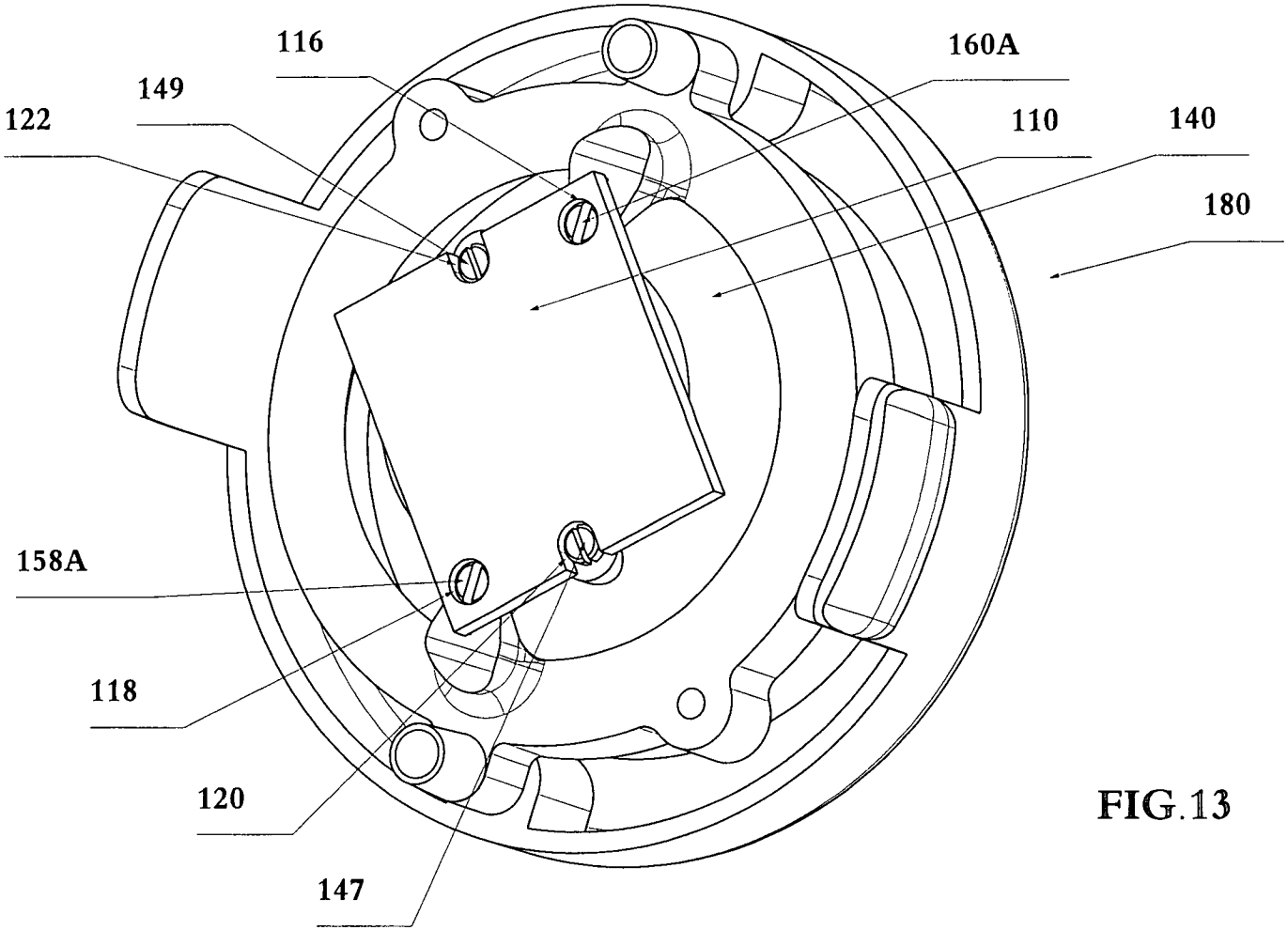
FIG. 13 is a top perspective view of the printed circuit board and reflector cover of the present invention.

The reflector cover 180 has a ring section 182 and a pair of spring sections with spring teeth thereon. First spring section 184 extends away from ring section 182 and has an exterior tooth member 185. Second spring section 188 is oppositely positioned to first spring section 184 on ring section 182, and also extends away from ring section 182 and also has an exterior tooth member 187. Ring section 182 also has a pair of oppositely disposed openings 190 and 192 extending through respective interior bosses 190A and 192A in ring section 182. The ring section 182 has an interior shelf 200 surrounding an opening 198, the interior shelf 200 having an upper surface 202. The interior shelf is adjacent interior surface 204 of ring section 182. Referring to FIGS. 1, 2 and 12, the reflector cover 180 also contains a lens 300 which is screwed into the reflector cover 180 and retained by teeth 180A, 180B and 180C (see FIG. 12).

The internal reflector 140 is positioned so that its opening 146 is aligned within opening 151 of frame member 150 and so that pin 147 is received within recess 120 of printed circuit board 110 and pin 149 is received within recess 122 of printed circuit board 110. In turn frame member 150 is positioned so that pin 158A is received in opening 118 of printed circuit board 110 and pin 160A is received in opening 116 of printed circuit board 110. The circumferential face 148 of internal reflector 140 rests on upper surface 202 of interior shelf 200 of the reflector cover 180 so that the internal reflector 140 is press fit retained between the frame member 150 and the reflector cover 180.

The internal reflector 140 has its opening 146 aligned with the LEDs 124. The internal reflector 140 is retained against the printed circuit board 110 so that its openings 146 is aligned with the LEDs 124 so that the internal reflector 140 evenly spreads illumination emitted from the LEDs and helps to distribute the light from the LEDS and avoid spot illumination.

Opening 190 of reflector cover 180 is aligned with opening 164 of boss 162 of frame member 150, and opening 164 is also aligned with fastener receiving opening 96 in the base 80 of heat sink 10. Opening 196 of reflector cover 180 is aligned with opening 168 of boss 166 of frame member 150, and opening 168 is also aligned with fastener receiving opening 92 in the base 80 of heat sink 10. With the interconnection of the pins 147 and 149 of the internal reflector 140 and pins 158A and 160A of the frame member 150 with the printed circuit board 110, the printed circuit board 110 and its LED 124 and the heat transmitting pad 126 are press fit retained against circular section 82 of base 80 of heat sink 10.

The assembly is retained together in the following manner. A first elongated fastening member 194 extends through aligned openings 190 in reflector cover 180, opening 164 in boss 162 of frame member 150 and into fastener receiving open 96 of base 80 of heat sink 10 and is affixed therein. First elongated fastening member 194 can heave threads on its end which enable the first elongated fastening member 194 to be threaded into fastener receiving opening 96 which can have mating internal threads. A second elongated fastening member 196 extends through aligned openings 192 in reflector cover 180, opening 168 in boss 166 of frame member 150 and into fastener receiving open 92 of base 80 of heat sink 10 and is affixed therein. Second elongated fastening member 196 can heave threads on its end which enable the second elongated fastening member 196 to be threaded into fastener receiving opening 92 which can have mating internal threads. In this way the entire assembly is retained together by only two fastening members. By way of example only, each fastening member 194 and 196 can be a hexagonal head threaded bolt.

The Led 124 is aligned with opening 151 in frame member 150, opening 146 in internal reflector 140 leading to interior surface 142 of internal reflector 140 and aligned with opening 198 in reflector cover 180.

Figure 15:
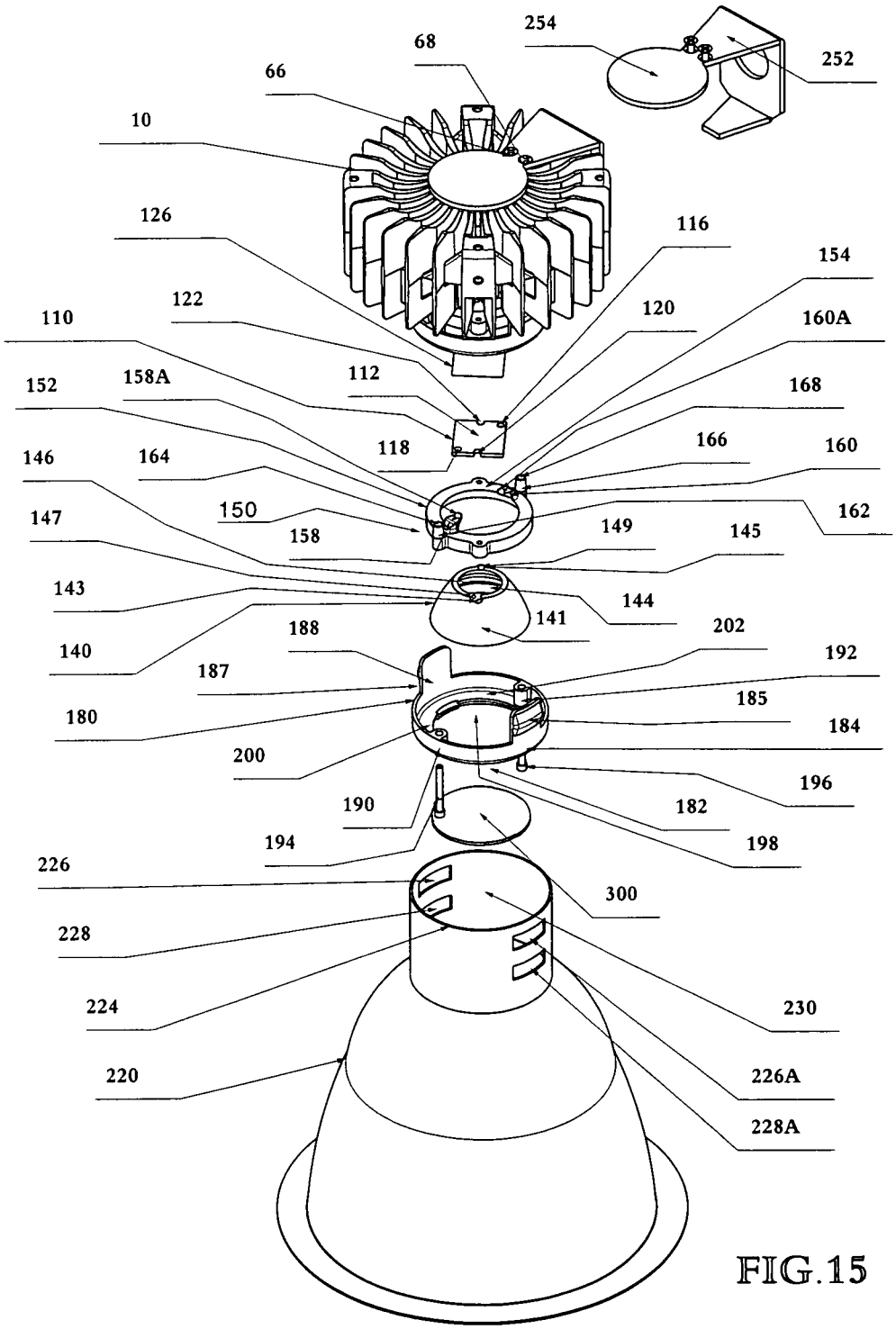
FIG. 15 is an exploded perspective view of components of the present invention and a luminaire reflector.

Referring to FIGS. 2 and 15, luminaire reflector 220 has an inner section 222 with a circumferential sidewall 224 having two sets of pairs of oppositely disposed openings 226 and 226A, and 228 and 228A. The circumferential sidewall 224 surrounds an interior opening 230. The reflector cover 180 is inserted into interior opening 230 of inner section 222 and the reflector cover spring sections 184 and 188 flex inwardly until a pair of teeth 185 and 187 are respectively inserted into either openings 226 and 226A or 228 and 228A to retain the heat sink assembly 100 onto the luminaire reflector 220. The luminaire reflector 220 has a lower circumferential ring 230. The circumferential ring 230 can be of any desired diameter such as 4 inches, 5 inches or 6 inches. The selected luminaire reflector 220 will be determined based on the size of the reflector ring 230 to be used in a particular application.

Referring to FIGS. 2, 11, 12 and 15, a bracket 250 has an upper transverse wall 252 extending at one end to a circular cover 254 and at its opposite end is affixed to a vertical wall 256 which extends to a lower transverse wall 258. The vertical wall 256 has an opening 256A through which electrical wires from the driver and other electrical components of the luminaire be connected to a source of power. Upper transverse wall 252 has a pair of openings 260 and 262 adjacent the location of circular cover 254. Openings 260 and 262 are respectively aligned with fastener receiving channels 67 and 69 of bosses 66 and 68 in heat sink 10. Fastening means such as screws or threaded bolts 264 and 266 are respectively inserted through aligned openings 260 and 67, and 262 and 69 so that bracket 250 is fastened to heat sink 10 so that circular cover 254 covers interior air gap 72. Lower transverse wall 258 rests below several fins 30.

Figure 16:
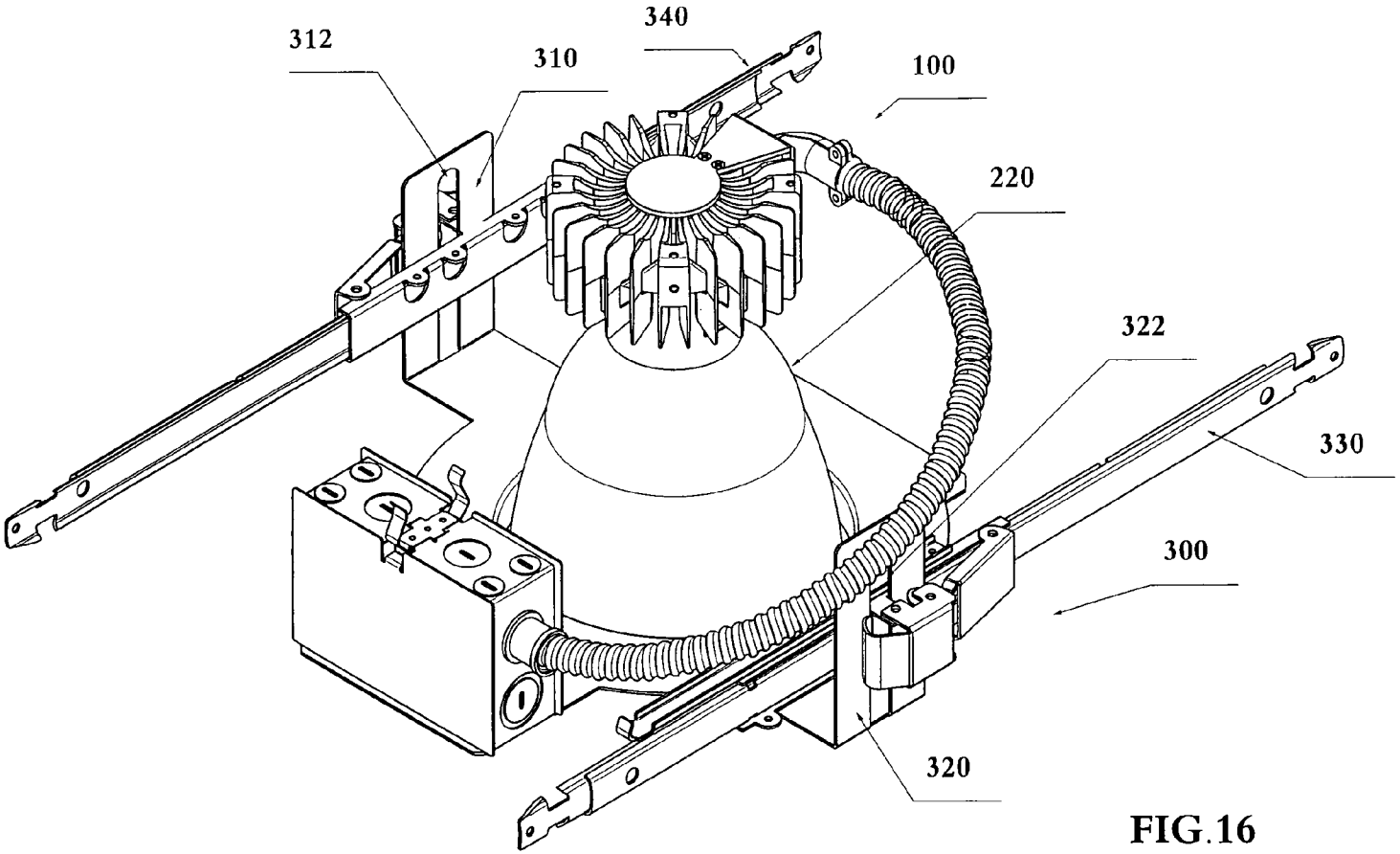
FIG. 16 is a perspective view of the assembled present invention affixed onto a recessed luminaire.

Referring to FIG. 16, the luminaire reflector 220 is affixed to a mounting assembly 300 which includes adjustable vertical mounting plates 310 and 320 respectively affixed to vertical adjustment means extending through interior slots 312 and 322 to adjust the height of the luminaire reflector 220 and heat sink assembly 100. Mounting brackets 330 and 340 mount the assembly to beams in a recessed ceiling area of a structure.

The heat sink 10 rests at the top of the LED luminaire 100 and heat is dissipated away from the LED 124 as previously described.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luminaire comprising:

a. a heat sink cast from a single piece of metal including a base having a generally circular central section, a first extension section and a second extension section which together form a generally elliptical non-circular shape;

b. a printed circuit board with a heat transmitting gel on an upper surface and containing an LED affixed to a lower surface, the printed circuit board press fit retained against a lower surface of the generally circular central section of the base so that at least a portion of the upper surface and heat transmitting gel contact the base of the heat sink;

c. the heat sink includes a body with a multiplicity of integrally cast spaced apart radial fins extending from the body in an outward radial direction, an air gap between adjacent radial fins, a portion of the body aligned with and having a shape conforming to the shape of the base and a lower section of each of the multiplicity of radial fins having an interior portion which extend from a portion of the body which conforms to the shape of the base, each fin of the lower section of radial fins extending radially outward to an exterior portion having a widened body portion;

d. the body extending from the base to a top surface, an upper section of the multiplicity of radial fins each having an interior portion with a lower surface in contact with the top surface of the body, the upper section of the multiplicity of radial fins surrounding the body with an interior surface of each interior portion of the upper section of the multiplicity of radial fins and the top surface of the body forming an internal air gap, the upper section of radial fins extending radially outward to an exterior portion having a widened body portion; and e. a respective fin section from the upper section of the multiplicity of radial fins aligned with a respective fin section from the lower section of the multiplicity of radial fins, each upper and lower aligned fin section separated from an adjacent aligned upper and lower fin section by at least one air gap, the heat sink body and multiplicity of radial fins are cast from a single piece of metal so that heat generated from the LED is transferred to and adsorbed into the base of the heat sink and the heat then travels through the body and into the multiplicity of radial fins and the heat is then caused to move to a space in a structure located above the heat sink and as a result heat generated by the LED is dissipated from the LED.

2. The luminaire in accordance with claim 1 further comprising a circumferential rib extending between several of the multiplicity of radial fins.

3. The luminaire in accordance with claim 1 further comprising:

a. the printed circuit board having a pair of oppositely disposed openings and a pair of oppositely disposed recesses;

b. a frame member have a circular ring surrounding an interior opening, a pair of oppositely disposed pins respectively retained on interior extending members which extend into the interior opening, the ring having a pair of oppositely disposed bosses with an internal opening respective extending through each boss;

c. an internal reflector having a base with an opening and extending to a wall with an interior surface and a circumferential face, the internal reflector having a pair of oppositely disposed pins on its base;

d. a reflector cover having a ring with an interior shelf surrounding an interior opening, a pair of oppositely disposed openings extending through the ring;

e. the heat sink having a pair of fastener receiving openings;

f. a respective opening in a boss of the frame member and a respective transverse opening in the reflector cover aligned with a respective fastener receiving opening in the heat sink, a respective fastening member extending through aligned openings to fasten the reflector cover and frame member to the heat sink, the internal reflector press fit retained between the frame member and the reflector cover so that a respective pin from the internal reflector is received in a respective recess of the printed circuit board and a respective pin from the frame member is received in a respective opening of the printed circuit board so that the printed circuit board is press fit retained against the heat sink.

4. The luminaire in accordance with claim 3, further comprising:

a. the reflector cover having a ring section and a pair of spring sections with spring teeth thereon, a first spring section extending away from the ring cover and having an exterior tooth member, a second spring section is located opposite to the first spring section, the second spring section having an exterior tooth member; and b. a luminaire reflector having an inner section with a circumferential sidewall having at least one pair of oppositely disposed openings, the circumferential sidewall surrounding an interior opening, the heat sink, printed circuit board and LED, frame, internal reflector and reflector cover forming a heat sink assembly, the ring of the reflector cover inserted into the interior opening of the inner section of the luminaire reflector and the spring sections flex inwardly until a pair of teeth are respectively inserted into the pair of oppositely disposed openings to retain the heat sink assembly onto the luminaire reflector.

5. The luminaire in accordance with claim 4 further comprising:

a. a bracket having an upper transverse wall extending at one end to a circular cover and at its opposite end is affixed to a vertical wall which extends to a lower transverse wall, fastening means by which the bracket is fastened to the heat sink so that the circular cover rests over the air gap formed by the multiplicity of radial fins and the top surface of the heat sink body.

6. The luminaire in accordance with claim 5 further comprising:

a. the luminaire reflector is affixed to a mounting assembly which includes adjustable vertical mounting plates respectively affixed to vertical adjustment means extending through interior slots to adjust a location of the luminaire reflector and heat sink assembly within a recessed ceiling area of a structure, the mounting brackets enabling the luminaire to be mounted to beams in a recessed ceiling area of a structure; and b. the luminaire reflector having a circumferential ring of a desired size to be accommodated by the mounting assembly.

7. A heat sink for use with a luminaire, the heat sink comprising:

a. a heat sink cast from a single piece of metal including a base having a generally circular central section, a first extension section and a second extension section which together form a generally elliptical non-circular shape;

b. the heat sink includes a body with a multiplicity of integrally cast spaced apart radial fins extending from the body in an outward radial direction, an air gap between adjacent radial fins, a portion of the body aligned with and having a shape conforming to the shape of the base and a lower section of each of the multiplicity of radial fins having an interior portion which extend from a portion of the body which conforms to the shape of the base, each fin of the lower section of radial fins extending radially outward to an exterior portion having a widened body portion;

c. the body extending from the base to a top surface, an upper section of the multiplicity of radial fins each having an interior portion with a lower surface in contact with the top surface of the body, the upper section of the multiplicity of radial fins surrounding the body with an interior surface of each interior portion of the upper section of the multiplicity of radial fins and the top surface of the body forming an internal air gap, the upper section of radial fins extending radially outward to an exterior portion having a widened body portion; and d. a respective fin section from the upper section of the multiplicity of radial fins aligned with a respective fin section from the lower section of the multiplicity of radial fins, each upper and lower aligned fin section separated from an adjacent aligned upper and lower fin section by at least one air gap, the heat sink body and multiplicity of radial fins are cast from a single piece of metal so that heat is absorbed into the body and then travels through the body and into the multiplicity of radial fins and away from the heat sink.

* * * * *